US005333440A

United States Patent [19]

Tsuzuki

[11] Patent Number: 5,333,440

[45] Date of Patent: Aug. 2, 1994

[54] AUTOMATED SPINNING APPARATUS AND PROCESS

[75] Inventor: Kiyohiro Tsuzuki, Greenville, S.C.

[73] Assignee: TNS Mills, Inc., Greenville, S.C.

[21] Appl. No.: 134,461

[22] Filed: Oct. 8, 1993

Related U.S. Application Data

[63] Continuation of Ser. No. 934,877, Aug. 21, 1992, abandoned.

[51] Int. Cl.[5] ..... D01H 13/04

[52] U.S. Cl. ..... 57/90; 57/315

[58] Field of Search ..... 57/90, 315, 308, 408

[56] References Cited

U.S. PATENT DOCUMENTS

| | | | |
|---|---|---|---|
| 317,675 | 5/1885 | Russell | 57/315 |
| 3,070,948 | 1/1963 | Tsuzuki | 57/308 |
| 3,191,375 | 6/1965 | Naegeli | 57/315 X |
| 3,469,385 | 9/1969 | Tsuzuki | 57/308 |
| 3,564,829 | 2/1971 | Tsuzuki | 68/5 D X |
| 3,650,104 | 3/1972 | Shepherd et al. | 57/408 |
| 3,787,615 | 1/1974 | Foerster et al. | 360/73.13 |
| 3,816,991 | 6/1974 | Takeuchi et al. | 57/90 |
| 3,834,148 | 9/1974 | Sakurai et al. | 57/413 |
| 4,022,007 | 5/1977 | Motobayashi et al. | 57/308 X |
| 4,098,065 | 7/1978 | Stahlecker et al. | 57/406 |
| 4,150,530 | 4/1979 | Derichs | 57/263 |
| 4,497,168 | 2/1987 | Kamp | 57/401 |
| 4,590,757 | 5/1986 | Stahlecker | 57/412 |
| 4,607,485 | 8/1986 | Stahlecker | 57/401, |
| 4,922,707 | 5/1990 | Meroni et al. | 57/408 |
| 4,932,201 | 6/1990 | Meroni et al. | 57/279 |
| 4,939,895 | 7/1990 | Raasch et al. | 57/263 |

*Primary Examiner*—Joesph I. Hail, III

*Attorney, Agent, or Firm*—Hardaway Law Firm

[57] ABSTRACT

A plant structure having three floors with first and second open-end spinning apparatuses located on the first floor and with vertical sliver feed tubes extending from the first and second open-end spinning apparatuses respectively to the second floor for feeding a sliver through the sliver feed tube to the first open-end spinning apparatus and to the third floor for feeding sliver from a can thereof to said second open-end spinning apparatus.

8 Claims, 2 Drawing Sheets

AUTOMATED SPINNING APPARATUS AND PROCESS

This application is a continuation of application Ser. No. 07/934,877, filed Aug. 21, 1992, now abandoned.

BACKGROUND OF THE INVENTION

This invention relates generally to the art of textiles and more particularly to a plant structure for the open-end spinning of textile fibers into yarn products.

Various plant structures have existed for the production of textile yarns for ultimately weaving or knitting into desired fabric.

Traditionally, two techniques of spinning have been utilized, i.e. ring spinning and open-end spinning. An example of open-end spinning is described in U.S. Pat. No. 4,939,895 to Raasch, et al. assigned to W. Schlafhorst & Co. of Germany. As described in this particular patent cans of coiled sliver typically are positioned on the floor adjacent to an open-end spinning apparatus and vertically bent upwardly into the open-end spinning apparatus.

An example of an open-end spinning apparatus is the Autocoro 240 automatic rotor spinning and winding machine produced and sold by W. Schlafhorst & Co.

While plants have effectively operated utilizing the arrangement as above described, room exists for improvement in the overall plant operations utilizing such open-end spinning devices.

SUMMARY OF THE INVENTION

It is thus an object of this invention to provide a novel plant arrangement of an open-end spinning apparatus.

It is a further and more particular object of this invention to provide such a novel open-end spinning apparatus arrangement wherein the number of such open-end spinning apparatuses may be maximized per square foot of the floor maintaining such apparatus.

It is a further and more particular object of this invention to provide a novel apparatus for feeding a sliver to an open-end spinning apparatus.

It is a further and yet more particular object of this invention to provide a novel plant structure for housing such open-end spinning apparatus.

These as well as other objects are accomplished by a plant structure having three floors with at least first and second open-end spinning apparatuses located on the first floor and with vertical sliver feed tubes extending from the first and second open-end spinning apparatuses respectively to the second floor for feeding a sliver through the sliver feed tube to the first open-end spinning apparatus and to the third floor for feeding sliver from a can thereof to said second open-end spinning apparatus.

DETAILED DESCRIPTION

In accordance with this invention it has been found that a plant housing apparatus for the open-end spinning of textile fibers into yarns may be operated with considerably greater efficiency both from the space standpoint and from the man hours standpoint by locating the open-end spinning apparatuses on the first floor of an at least three story plant structure and by feeding sliver to the spinning apparatuses alternately from the second and third floors of the plant facility. Sliver feed tubes are provided to appropriately direct the sliver from the second and third stories to adjacent spinning apparatuses. Various other advantages and features will become apparent from the following description given with reference to the various figures of drawings.

Figure 1:
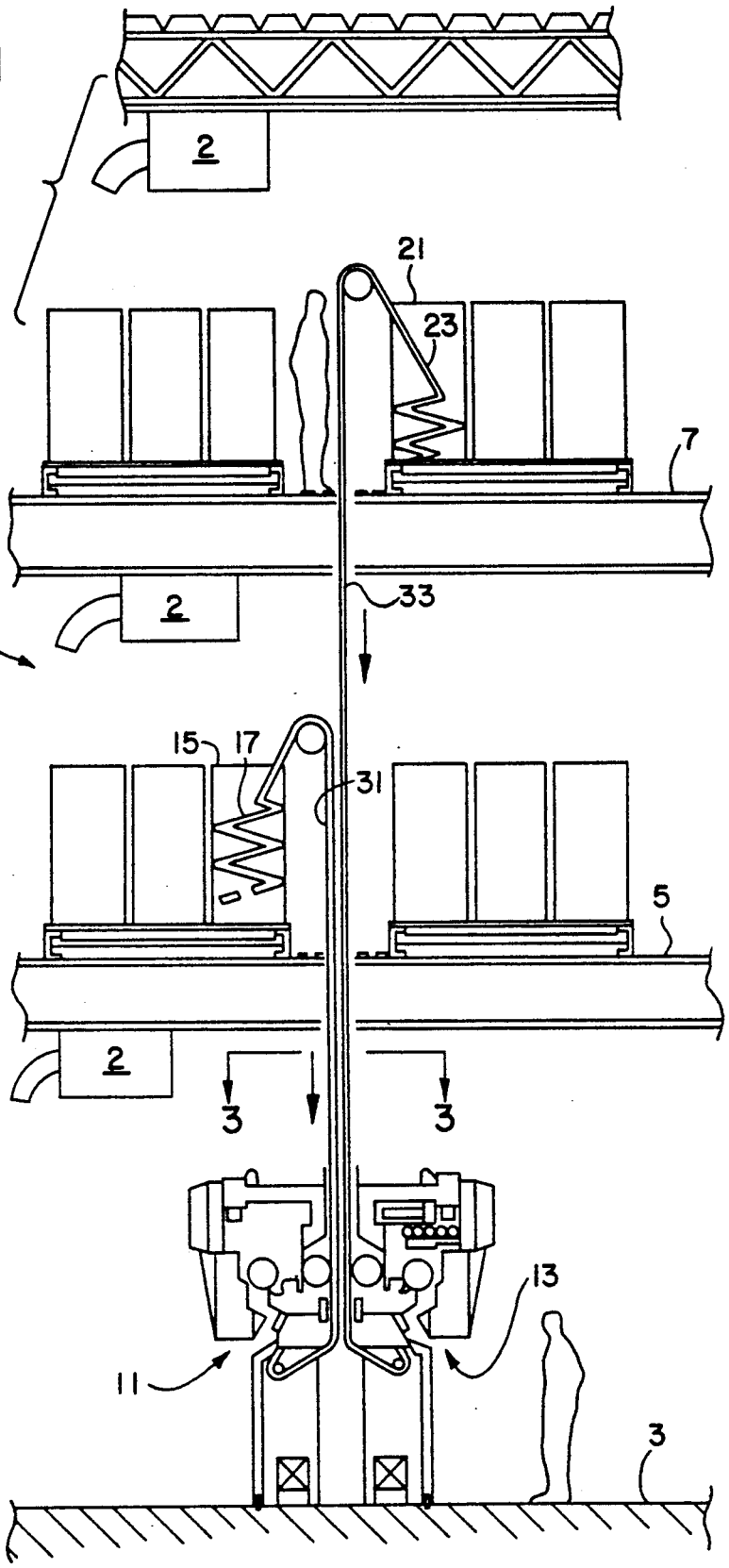
FIG. 1 of the drawings illustrates a plant structure in accordance with this invention.

FIG. 1 of the drawings illustrates generally a plant structure 1 having a first floor 3, a second floor 5 and a third floor 7. Located on the first floor or ground floor 3 are first and second open-end spinning apparatuses 11 and 13. Such open-end spinning apparatuses 11 and 13 may be of the type described in U.S. Pat. No. 4,939,895 referenced above and which is herewith incorporated by reference and may also be of the type marketed by Schlafhorst as the Autocoro 240.

Located on the second floor 5 are a plurality of cans referenced as 15 containing sliver 17 spiralled therein. Sliver therein is formed by techniques known in the textile art for the cleaning and opening of textile fibers such as cotton.

The third floor 7 contains an arrangement similar to the second floor having cans such as 21 having also sliver 23 coiled therein.

The arrangement in accordance with this invention of utilizing sliver cans on the second and third floors permit the second and third floors to have very tightly controlled temperature and humidity conditions so as to have a sliver properly conditioned for the open end-spinning process. This is achieved by the use of conventional air conditioners 2 located on the second and third floors. There is significant efficiency and energy savings associated with the maintenance of the sliver containers in the second and third floor configuration of this invention. The first floor, housing the open end spinning apparatus, is maintained at a different temperature and humidity which is more appropriate for spinning by the use of a conventional air conditioner 2 similar to that described above. It has been found to be highly advantageous to separately maintain the sliver at an optimum conditioning temperature while spinning at a different but optimum spinning temperature and humidity.

The usual conventional open-end spinning can is normally at a maximum of twenty inches by forty-eight inches which does not allow a significant amount of sliver in each can and requires significant and frequent replacement. According to this invention, however, thirty inch by fifty inch cans can be utilized allowing more sliver into the can and considerably less frequent changing of the cans.

Sliver feed tubes 31 and 33 extend respectively from the second floor 5 and the third floor 7 to appropriately direct the sliver to open-end spinning apparatuses 11 and 13.

Figure 2:
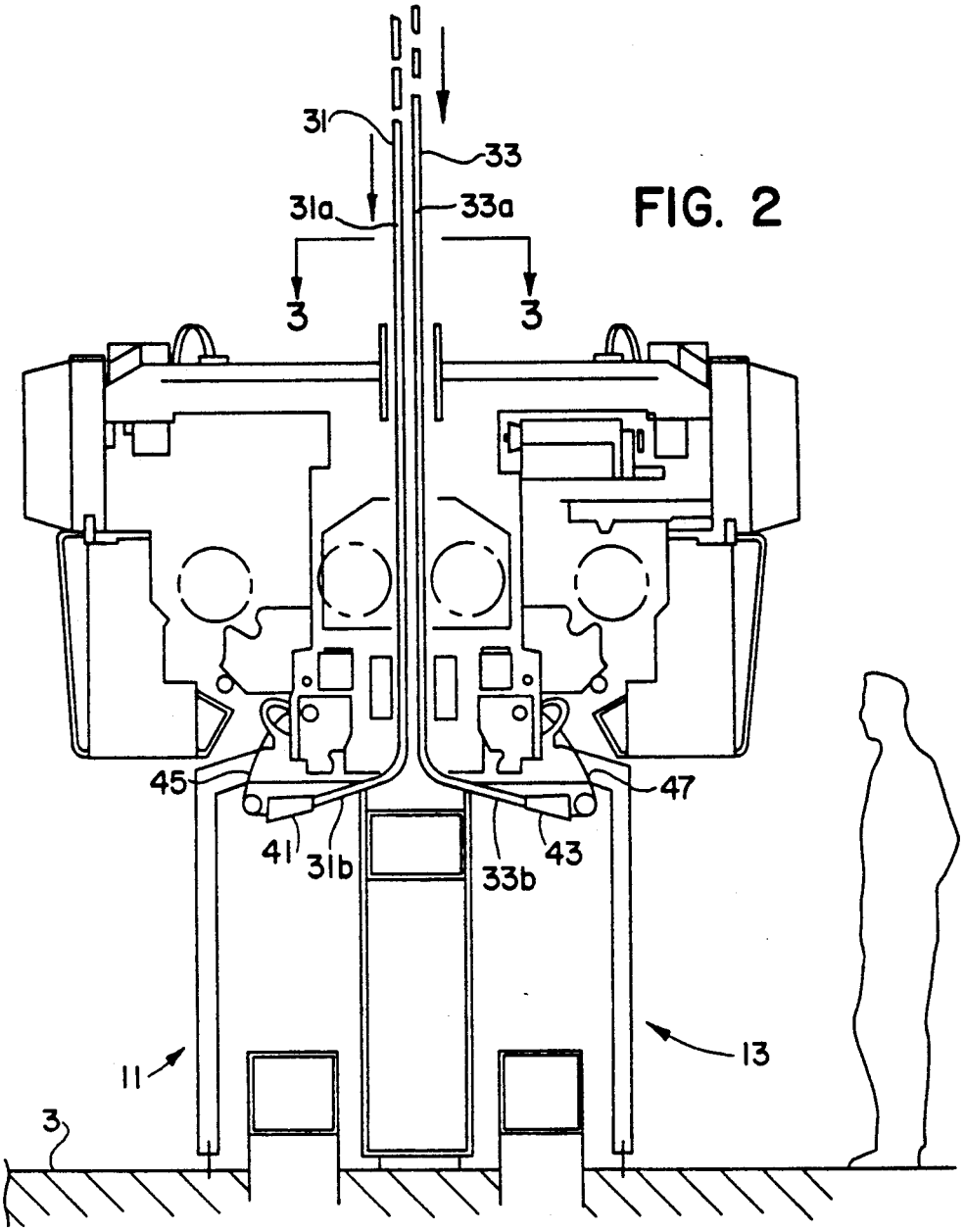
FIG. 2 of the drawings schematically illustrates the feeding of an open-end spinning apparatus in accordance with this invention.

Referring to FIG. 2 of the drawings which is shown in greater detail with regard to the first floor structure, it is seen that the sliver feed tubes 31 and 33 containing sliver portions **31*a* and 33*a* respectively after extending vertically downwardly return and direct the sliver portions 31*b* and 33*b* to a horizontally oriented end portion 41 for feed tube 31 and 43 for feed tube 33. At this point, the sliver 45 and 47 respectively is exposed and fed upwardly to the intake of the open-end spinning apparatus. Utilizing this construction, no modification of the open-end spinning apparatus is required and generally the open-end spinning apparatus still receives the sliver in the same manner that it would receive a sliver if it were fed directly from a can thereof placed on the ground floor 3**.

The sliver feed tube utilized in accordance with this invention is generally a smooth, hollow construction and preferably is made transparent so that the movement of the sliver through the tube may be visually observed.

It is critical to this invention to have the sliver go down through the tubes without any breakage. The tube must be of sufficient diameter to permit the sliver to pass down in a snake-like fashion without significant rubbing on the walls of the tube. The tube walls also include an anti-static agent to prevent sticking should contact occur.

Figure 3:
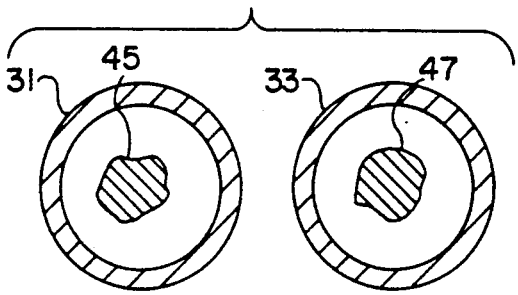
FIG. 3 of the drawings is a cross-sectional view along the line 3—3 of FIG. 1.

Referring to FIG. 3 of the drawings, which is a cross-section along the line 3-3 of FIG. 1, sliver feed tubes 31 and 33 are illustrated in cross-section and show respectively sliver 45 and 47 passing therethrough. It should be noted that the interior surface of the sliver feed tubes 31 and 33 should be very smooth so as to not snag sliver passing therethrough. A material possessing the requisite characteristics of smoothness is generally an extruded tubing formed from the type of material normally utilized for beverage containers.

Referring again to FIG. 1, it is seen that the sliver feed tubes pass through the floor structures of the second and third floors 5 and 7. The sliver feed tubes may be immediately adjacent a sliver can or may terminate just above the appropriate floor structure.

It is thus seen that this invention provides a novel plant structure for the open-end spinning of textile fibers into yarns. It is seen that such plant structure maximizes efficiency with regard to space utilization and worker accessibility to machinery. As many variations will become apparent to those of skill in the art, such variations are embodied within the spirit and scope of this invention as measured by the following appended claims.

That which is claimed is:

1. In an open-end spinning apparatus having means to receive sliver for the spinning thereof into yarn, the improvement comprising:

a sliver feed tube for feeding sliver to said open-end spinning apparatus, said sliver originating form a sliver source disposed two floors above said open-end spinning apparatus; and said sliver feed tube having a vertical portion, an obtuse portion forming an obtuse angle with said vertical portion at a lower end of said vertical portion, and a horizontal portion; such that said sliver travels downwardly through the vertical portion, then through said obtuse portion, and then through said horizontal portion.

2. In an open-end spinning apparatus according to claim 1 wherein said sliver feed tube is unobstructed at all points inside its core and at both its ends.

3. In an open-end spinning apparatus according to claim 1 wherein said sliver feed tube is made from an extruded material.

4. In an open-end spinning apparatus according to claim 1 wherein an inside of said sliver feed tube is coated with an anti-static agent.

5. A plant structure for the treatment of textile fibers to form such fibers as yarn, comprising:

a building structure having first, second and third floors therein;

at least first and second open-end spinning apparatuses located adjacent one another on said first floor;

a first sliver feed tube on said second floor for directing sliver from a can located on said second floor to said first open-end spinning apparatus;

a second sliver feed tube extending from said third floor to said second open-end spinning apparatus for directing sliver from a can located on said third floor to said second open-end spinning apparatus; and each said first and second sliver feed tubes having a vertical portion, an obtuse portion forming an obtuse angle with said vertical portion at a lower end of said vertical portion, and a horizontal portion; such that said sliver travels downwardly through said vertical portion, then through said obtuse portion, and then through said horizontal portion.

6. A plant structure for the treatment of textile fibers according to claim 5 wherein said first and second sliver feed tubes are unobstructed at all points inside their cores and at all their respective ends.

7. A plant structure for the treatment of textile fibers according to claim 5 wherein said first and second sliver feed tubes are made from an extruded material.

8. A plant structure for the treatment of textile fibers according to claim 5 wherein an inside of said first and second sliver feed tubes are coated with an anti-static agent.

* * * * *